BEST AVAILABLE COPY

United States Patent [19]

Hagan

[11] Patent Number: 4,671,436

[45] Date of Patent: Jun. 9, 1987

[54] SYPHON ASSEMBLY AND PACKAGE INCORPORATING THE ASSEMBLY

[75] Inventor: Richard J. Hagan, San Carlos, Calif.

[73] Assignee: McKesson Corporation, San Francisco, Calif.

[21] Appl. No.: 635,450

[22] Filed: Jul. 31, 1984

[51] Int. Cl.[4] ..... B65D 83/00

[52] U.S. Cl. ..... 222/402.25; 222/518; 215/4; 251/61.1; 251/244; 251/291; 251/342

[58] Field of Search ..... 222/501, 402.1, 402.13, 222/402.25, 402.15, 394, 402.24, 511, 514, 518, 78; 215/4, 5; 251/291, 244, 243, 342, 61.1

[56] References Cited

U.S. PATENT DOCUMENTS

| | | | |
|---|---|---|---|
| 676,009 | 6/1901 | Ripper | 222/394 |
| 2,500,119 | 3/1950 | Cooper | 222/394 |
| 2,543,850 | 3/1951 | Henricson | 222/78 X |
| 2,830,745 | 4/1958 | Aicart | 222/402.15 X |
| 2,863,699 | 12/1958 | Elser | 222/402.24 |
| 2,913,749 | 11/1959 | Ayres | 222/402.24 X |
| 3,333,743 | 8/1967 | Meyers | 222/402.1 |
| 3,348,742 | 10/1967 | Assalit | 222/514 X |
| 3,601,287 | 8/1971 | Schwartzman | 222/518 X |
| 3,863,673 | 2/1975 | Sitton | 222/511 X |
| 4,194,653 | 3/1980 | Brown | 222/402.25 |
| 4,502,618 | 3/1985 | Bushnell | 222/396 |

*Primary Examiner*—Joseph J. Rolla
*Assistant Examiner*—Gregory L. Huson
*Attorney, Agent, or Firm*—Flehr, Hohbach, Test, Albritton & Herbert

[57] ABSTRACT

A syphon package (12) incorporates a deformable, resilient plastic sealing member (42) which, in its normal position, blocks passageway (50) for dispensing seltzer water (32) stored under pressure in the package (12). Tube (30), valve sealing member (42) and insert (44) are assembled by bonding insert (44) to flange (40) with sealing member (42) in place. The resulting assembly is then bonded to interior wall (22) of necked opening (16). A syphon head (24) has a one-piece actuator (60) bonded to body (28), with actuating rod (62) supported on resilient diaphragm (64) for downward movement by lever (74) to deform sealing member (42) out of sealing engagement with passageway (50).

14 Claims, 7 Drawing Figures

BEST AVAILABLE COPY

BEST AVAILABLE COPY

BEST AVAILABLE COPY

BEST AVAILABLE COPY

BEST AVAILABLE COPY

SYPHON ASSEMBLY AND PACKAGE INCORPORATING THE ASSEMBLY

CROSS-REFERENCE TO RELATED APPLICATION

This application and a copending application by Richard J. Hagan, Ser. No. 06/609,280, filed May 10, 1984 and entitled "METHOD AND APPARATUS FOR STORING AND DISPENSING FLUIDS CONTAINERED UNDER GAS PRESSURE", now abandoned in favor of continuation-in-part application Ser. No. 06/685,912, filed Dec. 27, 1984, are directed to related inventions.

BACKGROUND OF THE INVENTION

1. Field of the Invention

This invention relates to a simplified syphon assembly for use to dispense liquids stored in a container under pressure and to a package incorporating the syphon assembly. More particularly, it relates to such a simplified syphon assembly and package especially adapted for use in the method and apparatus disclosed in the above referenced related application.

The related application discloses an apparatus incorporating a syphon head for dispensing seltzer water and other liquids stored under pressure. In the apparatus there disclosed, a recyclable or disposable container with the liquid under pressure is provided for use with a reusable syphon head. A convential closure is removed from the container at the time the syphon head is installed on the container. Since the pressure is not applied to the closure, its removal and replacement with the syphon head does not disturb the pressurized liquid. Actuation of the syphon head opens a valve provided in an insert of a necked opening in the container to discharge the pressurized liquid from the container.

2. Description of the Prior Art

The substantial prior art on syphon seltzer bottle technology is summarized in the related application. Briefly, conventional seltzer bottles are provided with syphon heads that remain permanently with the bottle. The head and bottle assembly is refilled with seltzer water under pressure for each use. The seltzer bottles and syphon head assemblies are of heavy duty, rugged construction in order to provide strength against the substantial gas pressures of up to 10 atmospheres employed in such seltzer bottles, and also to allow reuse of the syphon head - bottle combination for many years.

The related application provides, for the first time, an apparatus and method in which the seltzer water or other liquid may be packaged under such substantial gas pressures in a recyclable or disposable container. However, in order to allow low cost, high volume manufacture and filling of such containers, further improvement in the design of the syphon head and valve assembly for release of the liquid from the container is required.

SUMMARY OF THE INVENTION

Accordingly, it is an object of this invention to provide a simplified valve for releasably confining beverages and other liquids under gas pressures of up to 10 atmospheres.

It is another object of the invention to provide a simplified syphon head assembly for use to actuate a valve for release of beverages and other liquids stored under gas pressures in a container at up to about 10 atmospheres.

It is a further object of the invention to provide a syphon head assembly and package of the type in which a valve and an actuating mechanism for the valve may be separated without loss of pressure in the package, having a reduced number of parts and which can be fabricated and assembled on a low cost, high volume basis.

The attainment of these and related objects may be achieved through use of the novel syphon assembly and package incorporating the assembly herein disclosed. The syphon head assembly of this invention is for use with a container having a necked opening and holding a beverage or other liquid under pressure. In one aspect of the invention, the syphon assembly has a tube dimensioned to extend from the necked opening into the liquid in the container. A valve is positioned proximate to the necked opening end of the tube. The valve has a frustoconical shaped resilient sealing member having an open base engaging the tube and a top normally biased by the resilient sealing member into sealing engagement with a passageway of the valve for the liquid to flow from the container through the necked opening. An actuating member is positioned in a syphon head to apply force to deform the resilient sealing member to move its top out of the sealing engagement with the passageway of the valve. The resilient sealing member has a plurality of apertures spaced around the top to allow the liquid to pass from the tube to the passageway of the valve when the resilient sealing member is deformed. A means extends from the syphon head for applying force to the actuating member to deform the sealing member. The syphon head has a body with threads or other means for attaching the syphon head to the necked opening.

In another aspect of the invention, the syphon assembly has a valve inserted in the necked opening for releasably confining a liquid under pressure in the container. A syphon head has a body configured for attachment to the necked opening. An actuating member for opening the valve is fixedly attached to the body. The actuating member incorporates, in integrated form, a rod extending downward within the body for engaging the valve when the body is attached to the necked opening, a resilient diaphragm extending substantially normal to the rod, and a ring portion surrounding the resilient diaphragm for attaching the actuating member to the body.

In a preferred embodiment of the invention, the syphon assembly incorporates both the above novel resilient sealing member and the above novel actuating member. In this structure, the syphon head body and actuating member may be separated from the valve without releasing pressure in the container. The container holding the liquid under pressure, with the closed valve in place, and a conventional closure provided over the necked opening, are distributed separately from the syphon head with the actuating member, which are attached to the package for dispensing pressurized beverage or other liquid.

The attainment of the foregoing and related objects, advantages and features of the invention should be more readily apparent to those skilled in the art, after review of the following more detailed description of the invention, taken together with the drawings in which:

BEST AVAILABLE COPY

DETAILED DESCRIPTION OF THE INVENTION

Figure 1:
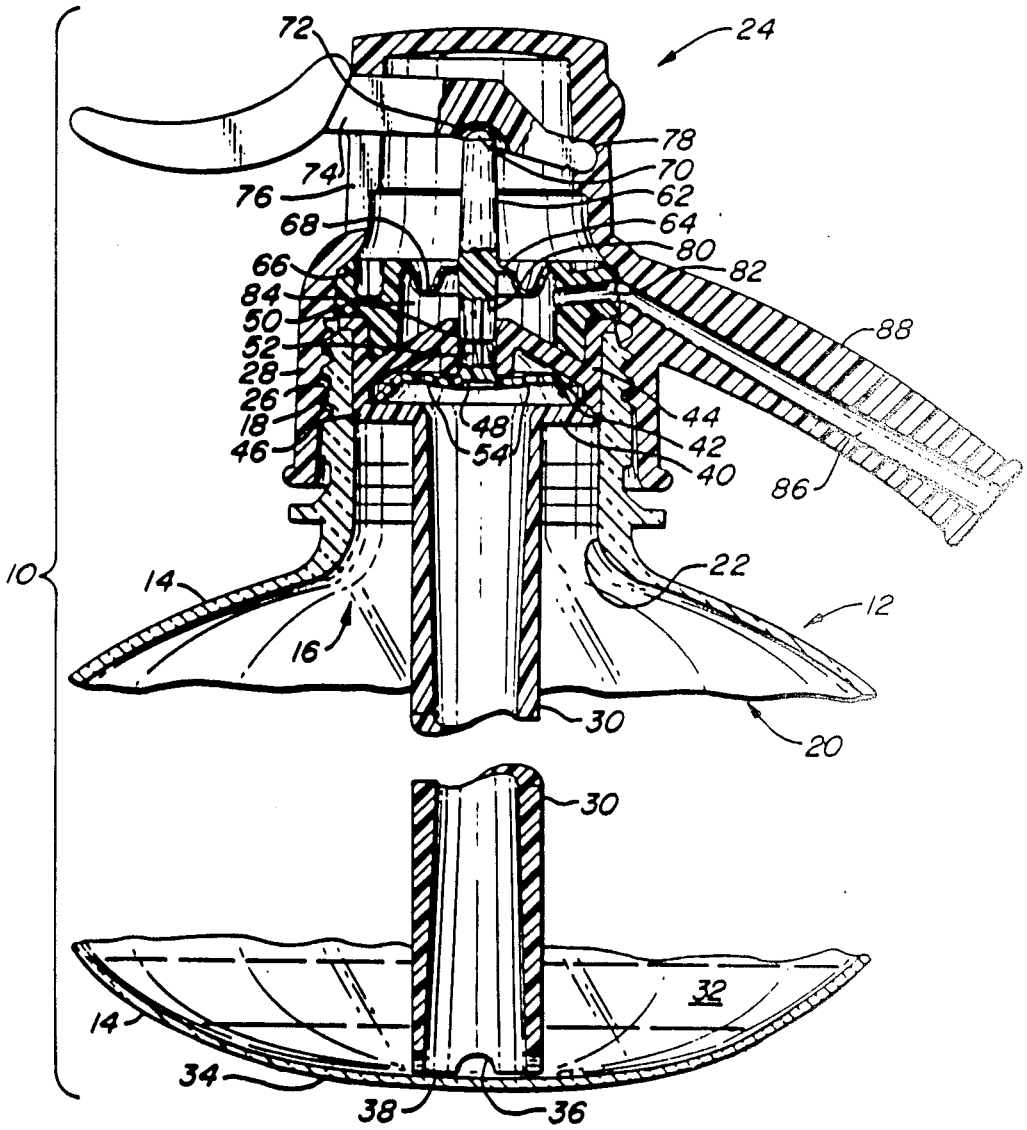
FIG. 1 is a cross-section view of a syphon head assembly and package incorporating the assembly in accordance with the invention.

Turning now to the drawings, more particularly to FIG. 1, there is shown a syphon assembly 10 and a seltzer water package 12 incorporating the syphon assembly 10, in accordance with the invention. The package 12 includes a high strength polyester terephthalate (PET) bottle 14 of the type described in the above referenced application, having a wall thickness of from about 18 to 20 thousandths of an inch. The bottle 14 has a necked opening 16 with exterior threads 18. The syphon assembly 10 includes an insert assembly 20, bonded to the inside wall 22 of the necked opening 16 and extending into the bottle 14. A head assembly 24 is attached to the necked opening by means of threads 26 on body 28, which mate with the threads 18 on the necked opening 16. When assembled in this manner, the head assembly 24 engages the insert assembly 20 during use of the seltzer water package 12.

The insert assembly 20 includes a tube 30 which extends from the necked opening 16 into the seltzer water 32 in bottle 14 and to bottom 34 of the bottle. Openings 36 are provided at end 38 of the tube 30 to allow the seltzer water 32 to enter the tube 30.

The tube 30 has a flanged upper end 40 within the necked opening 16. A resilient, substantially frustoconical shaped valve sealing member 42 rests on end 40 of the tube 30. Insert 44 fits over the valve sealing member 42 and is bonded to edge 46 of the tube end 40. The tube end 40 and insert 44 are both bonded in sealing engagement to the interior surface 22 of necked opening 16. Valve sealing member 42 has a raised portion 48, which normally seals centrally disposed passageway 50, which extends through the insert 44. A cruciform cross-section valve guide 52 extends upward from the raised portion 48 into the passageway 50. Openings 54 are provided around the raised portion 48 through the valve sealing member 42.

Figure 3:
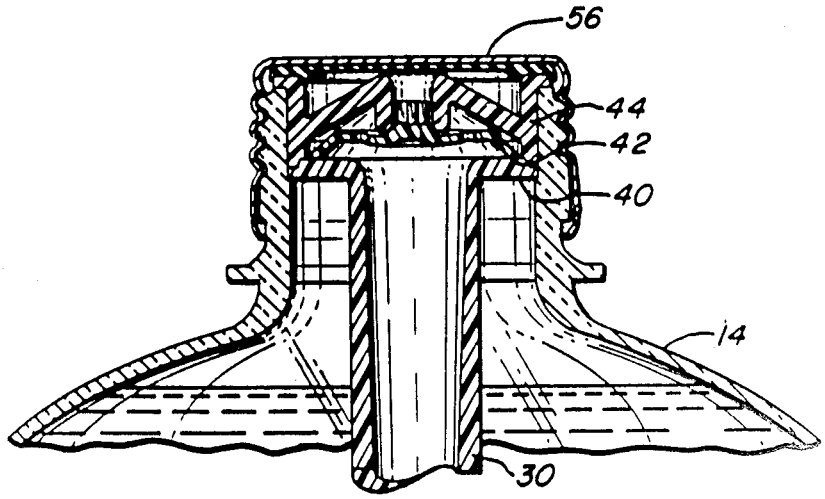
FIG. 3 is a cross-section view of a portion of the package shown in FIGS. 1 and 2.

FIG. 3 shows the necked portion 16 of the bottle 14 and the insert assembly as the packaged seltzer water 32 is sold. A conventional aluminum twist-off cap 56 is fastened over the necked opening 16 by means of the screw threads 18. Pressure from the seltzer water 32 in bottle 14 is not applied to the cap 56 because passageway 50 is sealed by the raised portion 48 of the valve sealing member 42.

Figure 2:
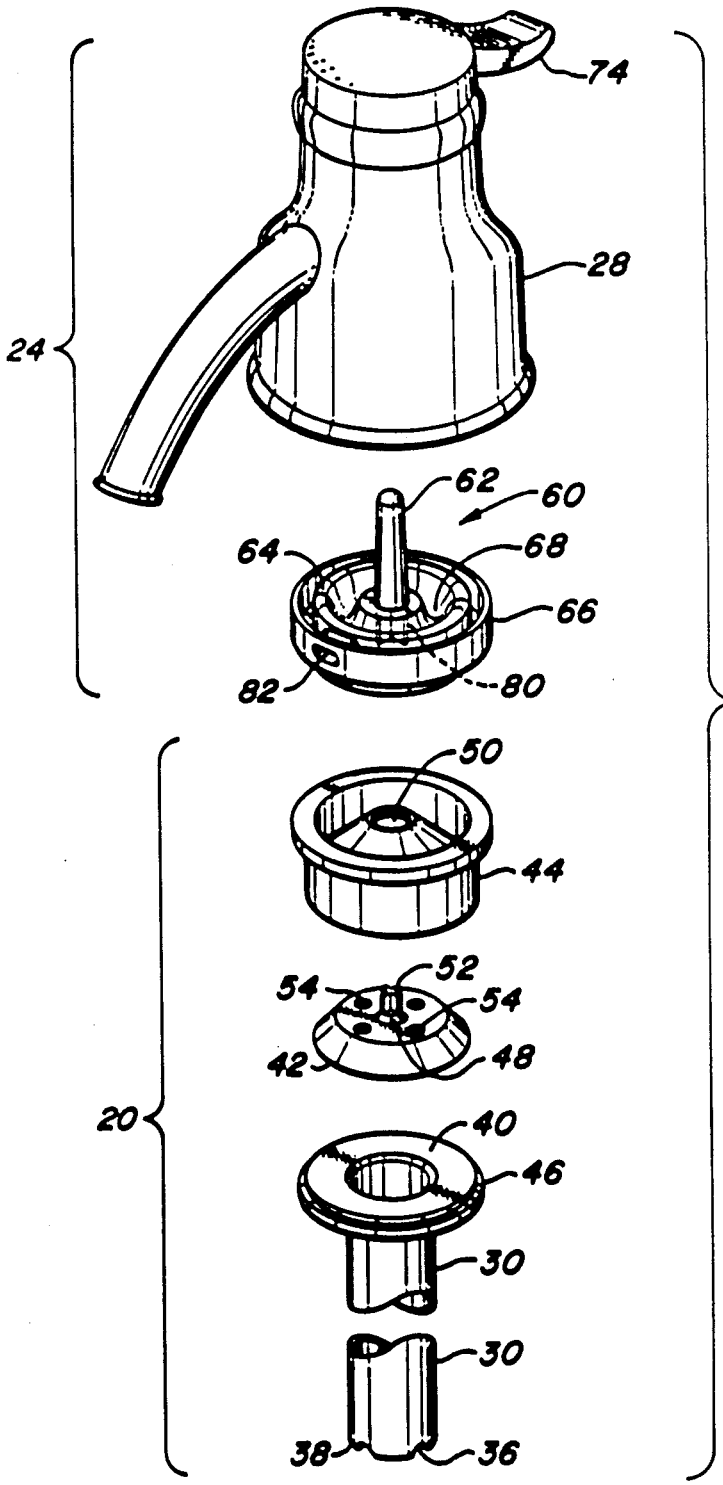
FIG. 2 is an exploded perspective view of the syphon head assembly shown in FIG. 1.

In use of the package 12, the purchaser removes the cap 56 and replaces it with the syphon head assembly 24, as shown in FIGS. 1 and 2. The package 12 is then ready to dispense the seltzer water 32.

The head assembly 24 includes a one-piece actuator 60, consisting of an actuating rod 62, a diaphragm 64 and a ring 66 for bonding the actuator 60 to body 28 of the head assembly 24. Bend 68 in the resilient diaphragm 64 provides spring tension in the diaphragm. Actuating rod 62 extends above the diaphragm 64 and has a curved end 70, which engages curved surface 72 of lever 74. Lever 74 extends through aperture 76 in body 28 and is pivotally connected to the body 28 at 78, on the opposite side of the body 28 from aperture 76. Actuating rod 62 has a cruciform cross-section portion 80 which extends downward from the diaphragm 64 to engage the cruciform cross-section projection 52 of the valve sealing member 42 within passageway 50. Ring 66 of the actuator 60 has an orifice 82 extending through the ring 66, to connect cavity 84, defined by the actuator 60 and the insert 44, to bore 86 within spigot 88.

Figure 4:
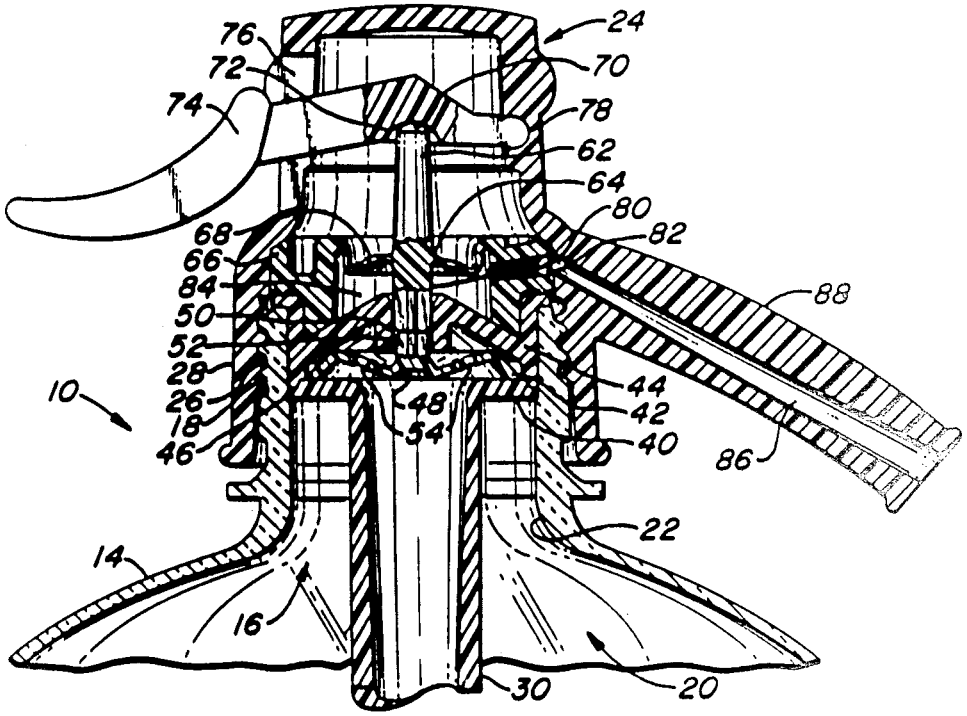
FIG. 4 is a cross-section view similar to FIG. 1, but showing the package of FIGS. 1-3 in use.

FIG. 4 shows the syphon assembly 10 in its open position, to discharge seltzer water 32 through spigot 88. As shown, when the lever 74 is depressed, actuating rod 62 is pushed downward, exerting force on the valve sealing member 42, deforming it away from sealing engagement with passageway 50. The seltzer water flows through apertures 54, passageway 50, cavity 84, and orifice 82 to spigot 88. When lever 74 is released, spring force from diaphragm 64 moves actuating rod 62 and lever 74 upwards, back to the position shown in FIG. 1, allowing valve sealing member 42 to assume its normal position sealing passageway 50.

In practice, tube 30, valve sealing member 42, insert 44, activator 60, head body 28 and lever 74 are preferably separately fabricated from a suitable plastic material in a molding operation. For this purpose, an injection molded co-polyester plastic is preferably employed. The valve sealing member 42 is placed on flanged end 40 of the tube 30, and insert 44 is then bonded to rim 46 of the end 40, such as by spin welding. The completed insert may then be placed into bottle 14 through necked opening 16. The insert assembly 20 is then bonded at insert 44 in sealing engagement to the interior wall 22 of the necked opening 16, such as by spin welding or with a suitable adhesive. Similarly, the actuator 60 is bonded at ring 66 to head body 28, such as by spin welding.

Figure 5:
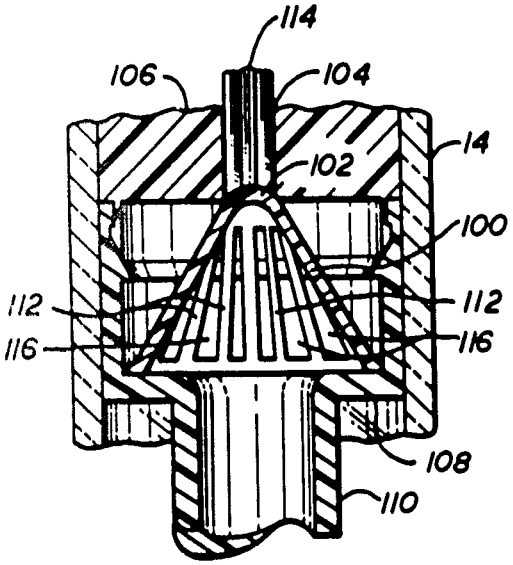
FIG. 5 is a cross-section view of a portion of another embodiment of a syphon head assembly in accordance with the invention.

FIG. 5 shows another embodiment of a valve sealing member 100, which may be used in place of the valve sealing member 42 shown in FIGS. 1-4. The valve sealing member 100 is still generally frustoconical in shape, but has a domed top 102, which engages passageway 104 of insert 106. End 108 of tube 110 is configured to receive the valve sealing member 100 and engage the insert 106. Legs 112 flex when actuating rod 114 presses down on top 102 to open the syphon. Spaces 116 between the legs 112 allow the seltzer water 32 to flow through the valve sealing member 100 when the top 102 has been moved away from passageway 104 by flexing of the legs 112. In other respects, the design and operation of a syphon package incorporating the FIG. 5 structure is the same as in the FIGS. 1-4 embodiment.

Figure 6:
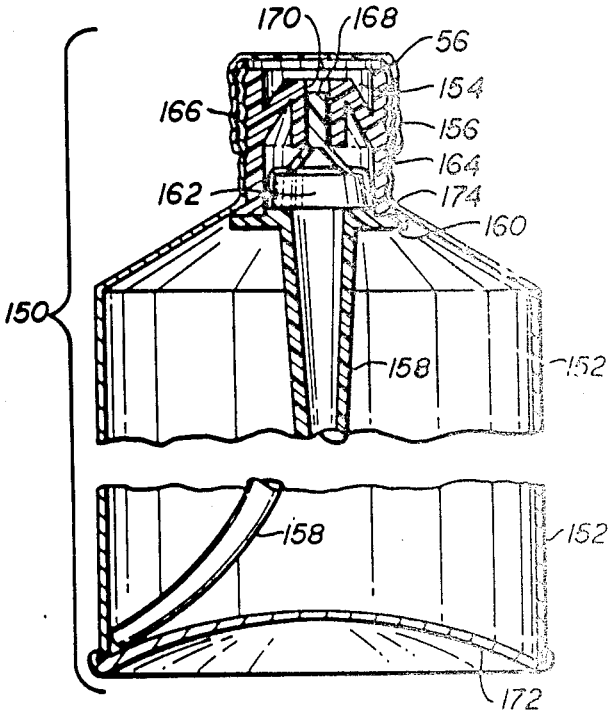
FIG. 6 is a cross-section view of a portion of another embodiment of a package in accordance with the invention.

FIG. 6 shows another embodiment of a syphon package 150 in accordance with the invention. The package 150 utilizes a metal can 152 having a necked opening 154 with external screw threads 156 for placement of a standard screw cap 56 over the necked opening 154. Tube 158 is similar in configuration to the tube 30 in the

BEST AVAILABLE COPY

FIGS. 1-4 embodiment, but has a flange 160 with a larger diameter than necked opening 154. Resilient valve sealing member 162 is also similar in configuration to the valve sealing member 42 in the FIGS. 1-4 embodiment. Insert 164 performs the same function as insert 44 in the FIGS. 1-4 embodiment, but has mating threads 166 for engaging the threads 156 on necked opening 154. Cruciform cross-section extension 168 of the resilient sealing member 162 extends into passageway 170 for engaging an actuating rod of a syphon head assembly (not shown) similar to the head assembly 24 of the FIGS. 1-4 embodiment.

In the fabrication of the FIG. 6 embodiment, insert 164 is bonded to flange 160 with resilient valve sealing member 163 in place, in the same manner as in the FIGS. 1-4 embodiment. The resulting assembly is then inserted by screwing into the necked opening 154 from within the can 152 prior to completing fabrication of the can 152 by rolling bottom 172 onto the remainder of the can 152. Because base 174 of insert 164 and flange 160 of the tube 158 are larger in diameter than the necked opening 154, substantially higher pressures can be employed within the can 152 without forcing the insert 164 from the necked opening 154.

Figure 7:
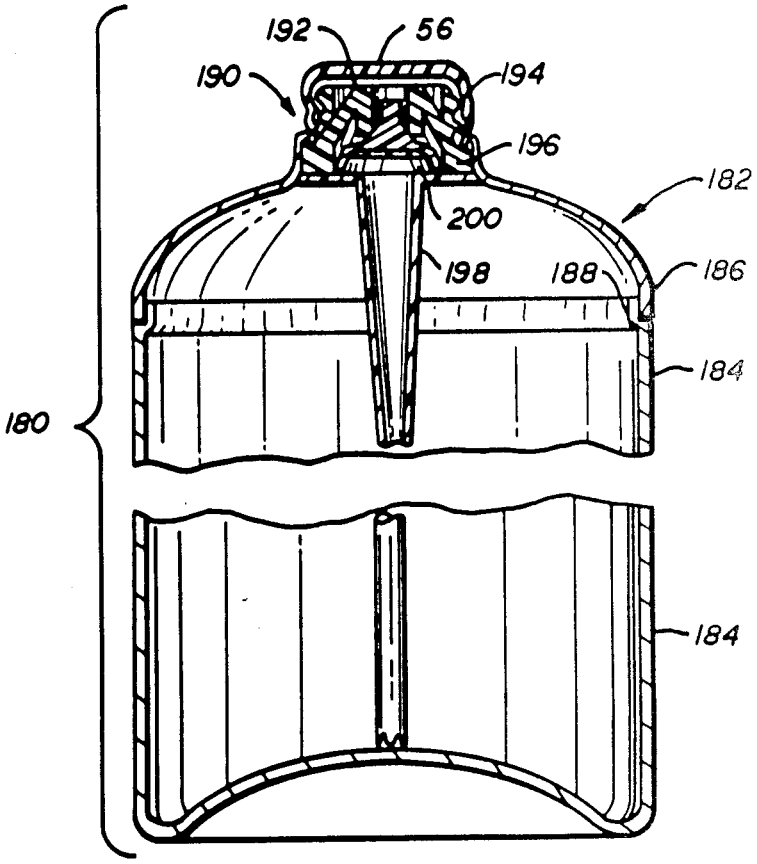
FIG. 7 is a cross-section view of a portion of still another embodiment of a package in accordance with the invention.

FIG. 7 shows another embodiment of a package 180 in accordance with the invention. This form of the invention utilizes a recently developed so-called "metal bottle" 182, which consists of a lower extruded aluminum body 184, and an upper crown 186, bonded to the lower body 184 by means of an adhesive at flange 188. The crown 186 has a rolled, necked opening 190. Insert 192 has screw threads 194 and a base 196 of larger diameter than the screw threads 194, for engagement by the rolled over necked opening 190. As in the case of the FIG. 6 embodiment, tube 198 and insert 192 are bonded together with a resilient valve sealing member 200 between them, and the resulting assembly is installed in the necked opening from the underside of crown 186 prior to bonding the crown 186 to the lower body 184. For shipping and sale of the package 182, a conventional screw cap closure 56 is provided on the screw threads 194 of insert 192.

It should now be readily apparent to those skilled in the art that a novel syphon assembly and package incorporating the assembly capable of achieving the stated objects of the invention has been provided. The valve structure provided in the assembly and package of this invention is substantially simpler in construction than the valve structure shown in my related application. The valve and syphon head are easily fabricated in high volume at low cost. A commercially practical recyclable or disposable syphon package may therefore be provided.

It should further be apparent to those skilled in the art that various changes in form and details of the invention as shown and described may be made. It is intended that such changes be included within the spirit and scope of the claims appended hereto.

What is claimed is:

1. A syphon assembly for use with a container having a necked opening and holding a liquid under pressure, which comprises a tube dimensioned to extend from the necked opening into the liquid in the container, a valve positioned proximate to the necked opening end of the said tube and having a passageway for the liquid to flow from said container through the necked opening, said valve having a frustoconical shaped resilient sealing member having an open base engaging said tube and a top normally biased by the resilient sealing member into sealing engagement with the passageway of said valve, an actuating member positioned in a syphon head to apply force to deform said resilient sealing member to move its top out of the sealing engagement with the passageway of said valve, said resilient sealing member having a plurality of apertures spaced around the top to allow the liquid to pass from said tube to the passageway of said valve when said resilient sealing member is deformed, means extending from said syphon head for applying force to said actuating member to deform said resilient sealing member, a body having a means for attaching said syphon head to the necked opening, said valve comprising an insert member positioned over said sealing member and bonded to the necked opening end of said tube around said sealing member, said insert having a side configured for bonding in a sealing fit to an interior surface of the necked opening of the container, said insert having a centrally disposed opening comprising the passageway of said valve, through which said actuating member contacts said sealing member, said actuating member comprising, in integral form, a rod extending into said centrally disposed opening and a resilient diaphragm extending substantially normal to said rod, said resilient diaphragm being fixedly attached around its periphery to said body, and said rod extending below said diaphragm to contact said sealing member.

2. The syphon assembly of claim 1 in which said force applying means comprises a lever extending through an opening in said syphon head body and pivotally mounted to an interior surface opposite to the opening, an upper end of said actuating member rod and said lever being connected by mating curved surfaces.

3. The syphon assembly of claim 1 in which said resilient diaphragm is fixedly attached to said body by a wall, said wall has an orifice extending from beneath said resilient diaphragm through said wall and said syphon head body has a spigot in mating relationship to the ring orifice of said actuating member.

4. The syphon assembly of claim 1 in which said syphon head body is threaded on its interior surface below the attachment of said actuating member for attachment to the mating threads on an exterior surface of the necked opening of the container, said actuating member is separable from said insert with said syphon head body without release of pressure in the container, and said insert is configured so that a threaded cap closure may be screwed to the threads on the necked opening.

5. The syphon assembly of claim 1 in combination with a container having a necked opening.

6. A syphon head assembly for use with a container having a necked opening and a valve inserted in the necked opening for releasably confining a liquid under pressure in the container, which comprises a body configured for attachment to the necked opening, an actuating member for opening the valve attached to said body, said actuating member comprising, in integrated form, a rod extending downward within said body for engaging the valve when said body is attached to the necked opening, resilient diaphragm extending substantially normal to said rod, said resilient diaphragm being fixedly attached around its periphery to said body by means of a wall having an orifice connecting an interior of said body beneath said resilient diaphragm to a spigot on said body in mating engagement with the orifice for discharge of the liquid from the container, said rod

BEST AVAILABLE COPY extending below said resilient diaphragm and being configured to engage the valve.

7. The syphon head assembly of claim 6 in which said body is configured for attachment to said necked opening by means of threads on an interior surface of said body below the attachment of said actuating member to said body.

8. The syphon head assembly of claim 7 in combination with a container having a necked opening, mating threads at said necked opening engaged by the threads on said body, and a valve positioned in the necked opening confining a liquid under pressure for release when said valve is opened by said actuating means.

9. The combination of claim 8 in which the mating threads are on an exterior surface of the necked opening.

10. The combination of claim 8 in which said valve is provided in an insert fixedly mounted to seal said necked opening and having a portion extending upwardly beyond said necked opening and the mating threads are on the upwardly extending portion of said insert.

11. The combination of claim 8 in which said valve is provided in an insert mounted in the necked opening, said insert has a tube with one end extending into the liquid and another end fixedly attached to the insert, the valve includes a resilient, substantially frustoconical sealing member having an open base contacting the insert end of the tube, a top biased into a sealing engagement with a passageway extending upward within said insert, and a plurality of apertures for passage of liguid from the tube through said sealing member for flow through said passageway said top is moved from sealing engagement with the passageway.

12. A package for holding a liguid under pressure, which comprises a container capable of withstanding a pressure of at least about three atmospheres and having a necked opening at a top of said container, a plastic syphon tube having a first end proximate to a bottom of said bottle and terminating in a flanged, second end extending into the neck of said opening, a plastic insert extending in sealed engagement along an interior wall of said opening to engage a periphery of the flange of said second tube end, said insert having a centrally disposed passageway positioned above said second tube end and leading out of said necked opening, a deformable, resilient plastic sealing member resting on the flange and having a top in sealing engagement with the centrally disposed passageway of said insert, the top of said resilient sealing member being movable out of sealing engagement with the centrally disposed passageway of said insert in response to downward force applied through the centrally disposed passageway, said resilient sealing member being configured to allow a pressurized liquid to pass from said second tube end through the passageway of said insert when said sealing member is deformed to move its top from the sealing engagement with the opening, a syphon head having a body attached to said necked opening, and an actuating member within said syphon head body and extending into said centrally disposed passageway to engage the top of said resilient sealing member, said actuating member comprising, in integral form, a rod extending into said centrally disposed passageway and a resilient diaphragm extending substantially normal to said rod, said resilient diaphragm being fixedly attached around its periphery to said body and said rod extending below said diaphragm to contact said sealing member.

13. The package of claim 12 additionally comprising a closure over said necked opening.

14. The package of claim 12 in which said actuating member further includes a ring portion around the resilient diaphragm and fixedly attached to said syphon head body.

* * * * *